US012371970B2

(12) United States Patent
Xu et al.

(10) Patent No.: US 12,371,970 B2
(45) Date of Patent: Jul. 29, 2025

(54) ACTUATOR, METHOD, AND SYSTEM

(71) Applicant: Baker Hughes Oilfield Operations LLC, Houston, TX (US)

(72) Inventors: YingQing Xu, Tomball, TX (US); Zhihui Zhang, Katy, TX (US); Matthew D. Solfronk, Katy, TX (US); Todd Christopher Jackson, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/180,516

(22) Filed: Mar. 8, 2023

(65) Prior Publication Data

US 2024/0301769 A1 Sep. 12, 2024

(51) Int. Cl.
*E21B 36/00* (2006.01)
*E21B 23/04* (2006.01)

(52) U.S. Cl.
CPC ..... *E21B 36/008* (2013.01); *E21B 23/0415* (2020.05)

(58) Field of Classification Search
CPC ..... E21B 36/008; E21B 23/0415; E21B 23/04
See application file for complete search history.

(56) References Cited

U.S. PATENT DOCUMENTS 8,322,426 B2 * 12/2012 Wright ..... E21B 23/06 166/376
9,664,007 B2 * 5/2017 Lopez ..... E21B 43/12
2009/0314497 A1 12/2009 Johnson
2010/0206633 A1 8/2010 Moore et al.
2014/0345851 A1 11/2014 Wright et al.
2021/0254611 A1 8/2021 Herbst et al.
2021/0301633 A1 9/2021 Alnoaimi et al.
2021/0372254 A1 12/2021 Thomas et al.

OTHER PUBLICATIONS

Notification of Transmittal of the International Search Report and the Written Opinion of the International Searching Authority, or the Declaration; PCT/US2024/018072; Mail date: Jun. 12, 2024; 8 pages.

* cited by examiner

*Primary Examiner* — Catherine Loikith
(74) *Attorney, Agent, or Firm* — Baker Hughes Company

(57) ABSTRACT

An actuator, including a housing having a flow conduit therethrough, a pressure balanced poppet disposed in the housing, initially preventing flow through the housing, and a heat evolving composition disposed to move the poppet by fluid heating to cease preventing flow through the housing upon ignition of the heat evolving composition. A method for actuating a tool, including igniting the heat evolution composition, heating a fluid located between the poppet and the housing, driving the poppet to move with the heated fluid, and flowing fluid through the housing. A borehole tool, including the actuator, a tool member disposed in the tool and movable by the fluid flowing through the housing, the movement of the tool member changing an operational condition of the tool. A borehole system, including a borehole in a subsurface formation, a string in the borehole, the actuator disposed within or as a part of the string.

18 Claims, 3 Drawing Sheets

ACTUATOR, METHOD, AND SYSTEM

BACKGROUND

In the resource recovery and fluid sequestration industries, actuation of tools in the downhole environment has been a significant consideration for decades and many methods have been devised but with greater sensitivity and smart wells becoming more prevalent, the actuation of tools in systems downhole requires greater and greater choreography. Accordingly, the art would well receive alternative actuators that can respond more rapidly than those of the prior art.

SUMMARY

An embodiment of an actuator, including a housing having a flow conduit therethrough, a pressure balanced poppet disposed in the housing, initially preventing flow through the housing, and a heat evolving composition disposed to cause the poppet to move by fluid heating to cease preventing flow through the housing upon ignition of the heat evolving composition.

An embodiment of a method for actuating a tool, including igniting the heat evolution composition, heating a fluid located between the poppet and the housing, driving the poppet to move with the heated fluid, and flowing fluid through the housing.

An embodiment of a borehole tool, including the actuator, a tool member disposed in the tool and movable by the fluid flowing through the housing, the movement of the tool member changing an operational condition of the tool.

An embodiment of a borehole system, including a borehole in a subsurface formation, a string in the borehole, the actuator disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
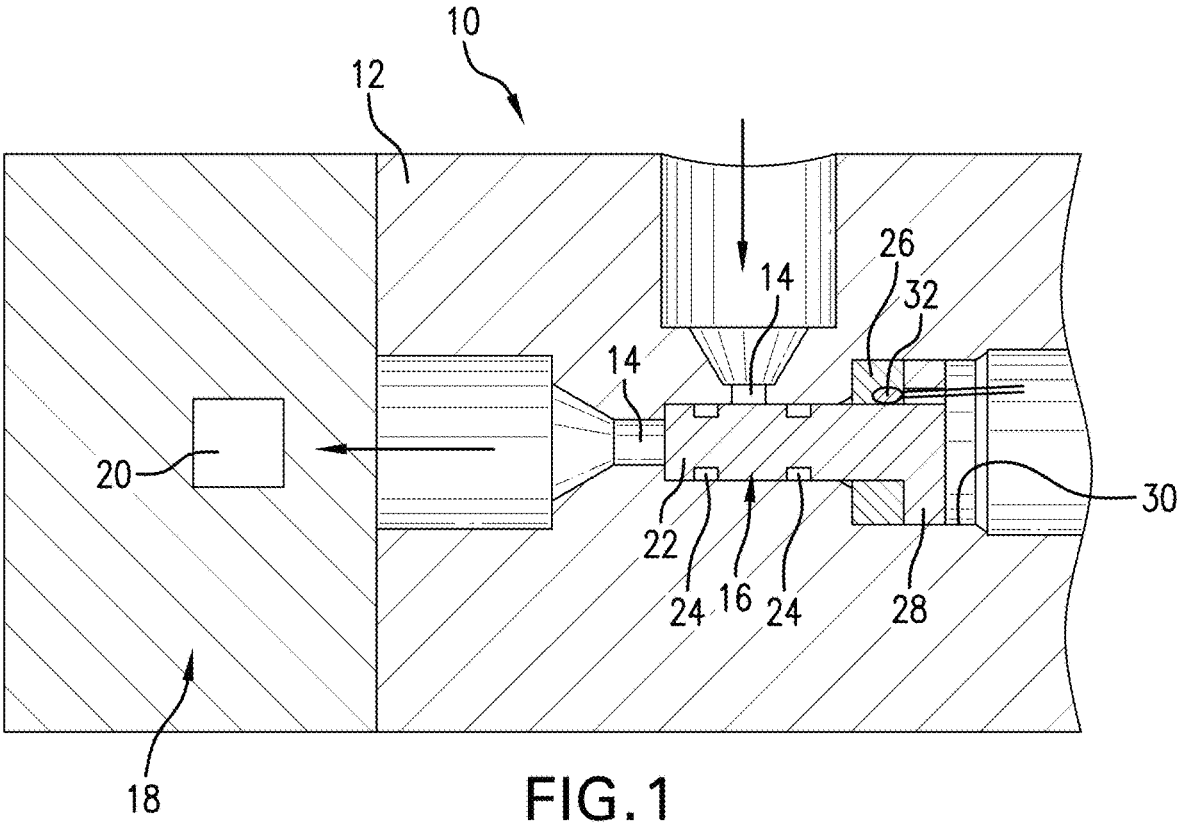
FIG. 1 is a schematic representation of an actuator as disclosed herein that may be made a part of a tool.

Referring to FIG. 1, an actuator 10 comprises a housing 12 having a flow conduit 14. A poppet 16 is disposed in the housing 12 in a way that closes the flow conduit 14 until the poppet is repositioned. As illustrated the conduit 14 extends from a source of hydrostatic pressure to a schematically illustrated tool 18 where a change in pressure due to exposure to hydrostatic pressure will cause a member 20 of the tool to change position or attitude and thereby to change an operational condition of the tool. Initially, the poppet 16 prevents access to the hydrostatic pressure because the poppet 16 includes a shaft 22 having seals 24 thereon that are positioned to straddle the conduit 14. In the position as illustrated in FIG. 1, (and that of FIG. 2 as well) the poppet 16 is pressure balanced in the initial position. Accordingly, there is no load acting on the poppet 16 that is attempting to move the poppet 16 into the original position or out of the original position. Rather, poppet 16 is insensitive to experienced pressure from the tool or the environment. In order to move poppet 16 and thereby open the conduit 14 to flow, actuator 10 includes a heat evolving composition 26 disposed in a position where its exposure to a fluid will cause heat absorption by the fluid resulting in expansion thereof and accordingly movement of the poppet 16. In a particular embodiment, illustrated in FIG. 1, the heat evolution composition 26 is disposed between a head 28 of the poppet 16 and in a recess 30 of the housing 12. The head 28 need not be sealed to the housing though a seal is also contemplated. The head 28 should however be a close fit in the recess 30 so that expanding fluid will primarily push the head 28 to move the poppet 16 to a conduit open position rather than simply escape around the perimeter of the head 28. Heat evolution composition 26 may be in a toroidal compact or in a powdered form, whether free or in a container of some kind, as desired. In embodiments, the composition 26 may be a gas evolutionless material that is helpful with regard to transportation regulations or may be a composition that does evolve gas. If the former, the heat generated is enough to move the poppet based upon the rapid heating of ambient fluid and if the latter, the evolved gas may assist in moving the poppet 16. The heat evolution composition 26 in some cases may be a thermite, thermite with polymeric binders, Nitrate propellent material, thermate, etc.

The heat evolution composition is ignited by an igniter 32 that may be electrically responsive. A trigger (not shown) is used to supply electric energy to the igniter based upon a remote command or local sensory input. On embodiment of a suitable igniter may be a Nichrome resistive wire, for example, which is widely commercially available.

Figure 1A:
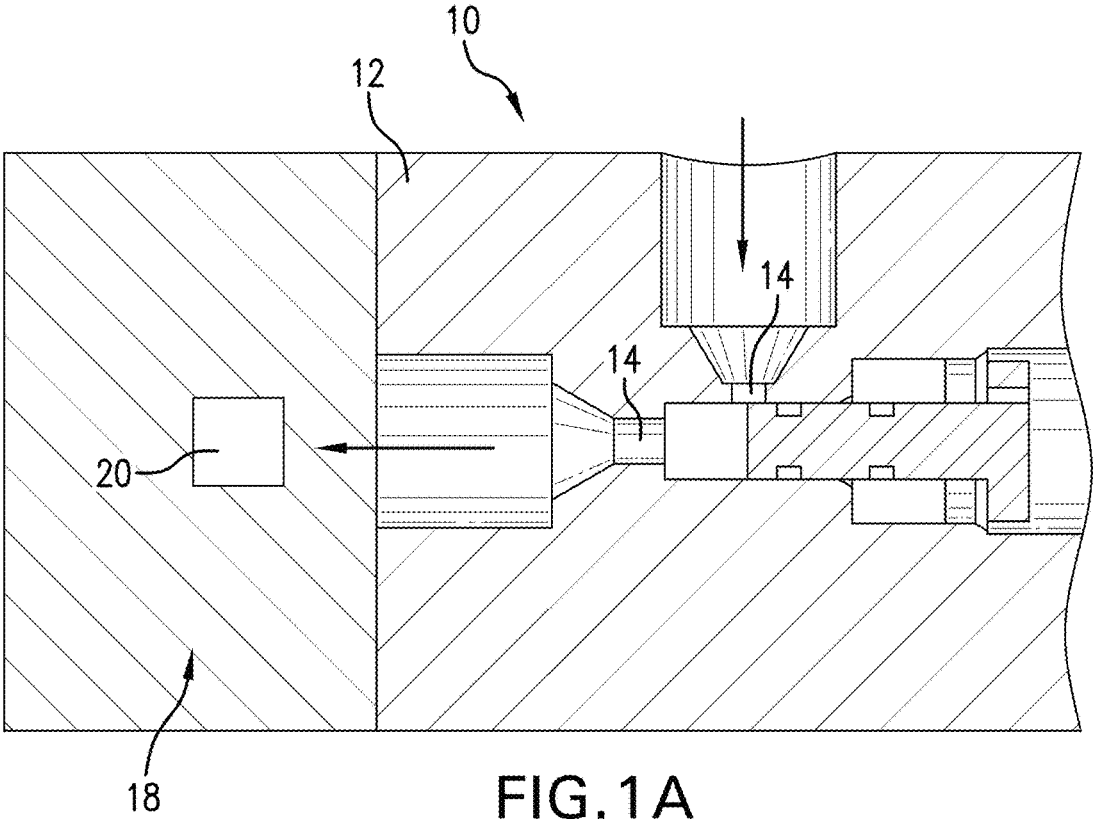
FIG. 1A is a schematic representation of the actuator of FIG. 1 with the poppet thereof in a position after composition ignition.

Upon ignition of the heat evolution composition 26, referring to FIG. 1A, the poppet 16 is driven to the right in of the Figures to unblock the flow conduit 14 thereby allowing hydrostatic pressure to reach and affect the member 20 of the tool 18, changing the operational condition of the tool.

Figure 2:
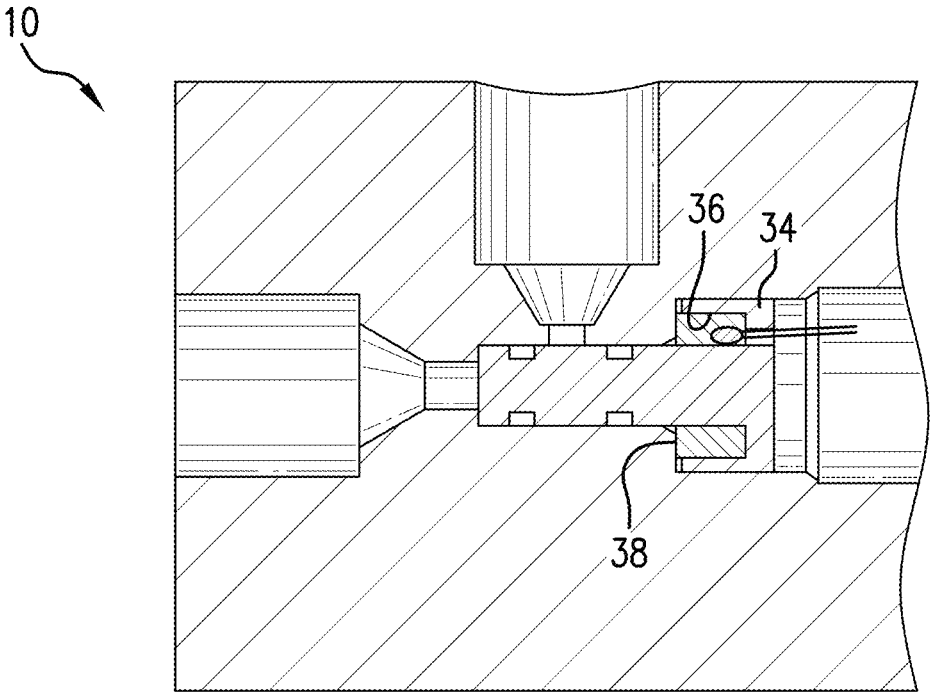
FIG. 2 is a variation of the actuator illustrated in FIG. 1.

Referring to FIG. 2, a similar actuator is illustrated with the distinction being the head of the poppet 16. In this embodiment, the head 34 includes a recess 36 therein within which to disposed the heat evolution composition 26. An epoxy of over closure 38 material may be used to temporarily encapsulate the heat evolution composition 26 in the recess 36, if desired. In other respect the actuator of FIG. 2 is the same as that of FIG. 1.

In each case, because the heat evolution composition 26 is of a type that evolves extreme heat virtually instantly a temperature rise in ambient fluid, which may simply be air, at the poppet 16 is so rapid that actuation of the tool will occur within 5 seconds of an ignition signal being received at the trigger.

Figure 3:
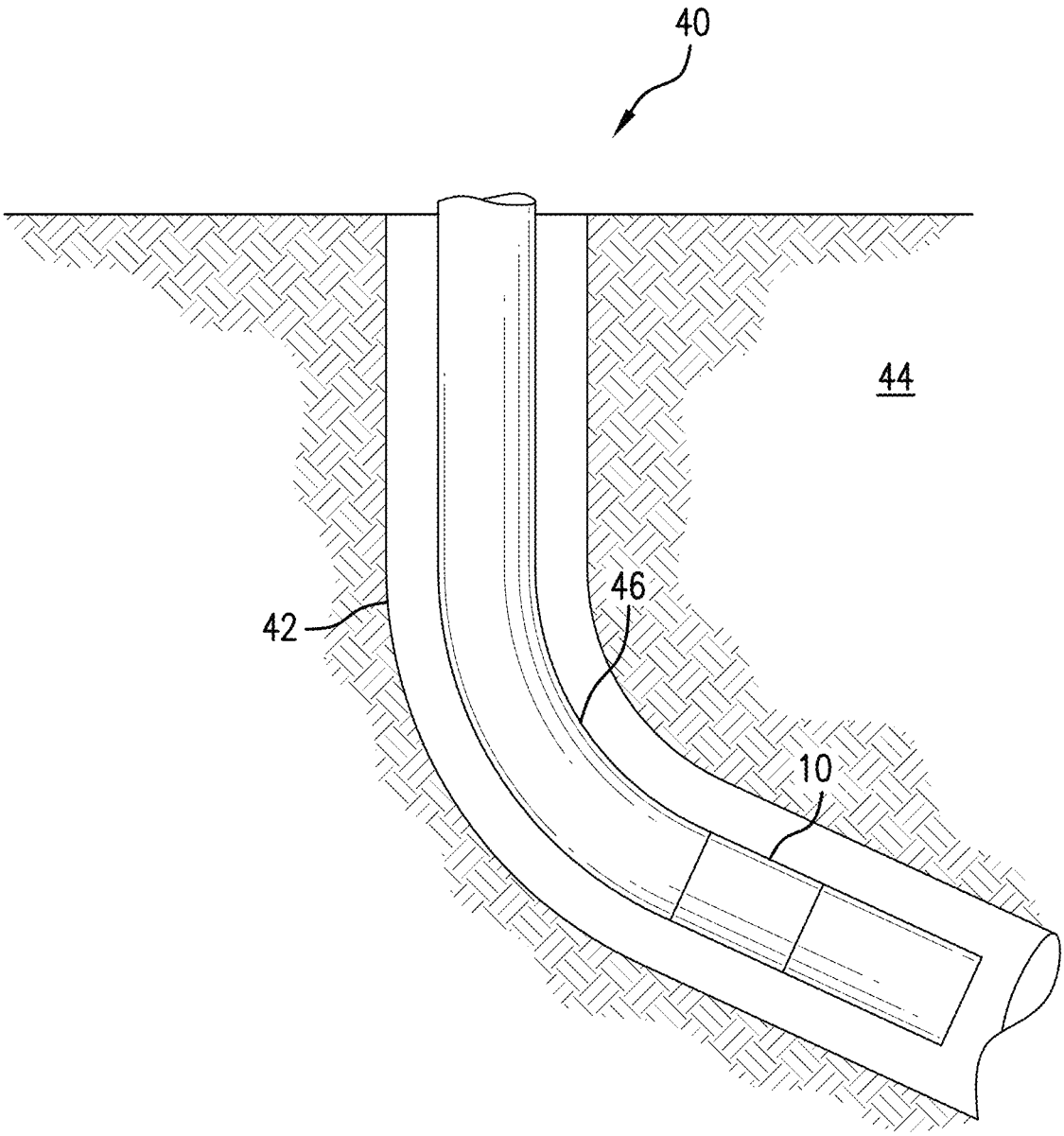
FIG. 3 is a view of a borehole system including the actuator as disclosed herein.

Referring to FIG. 3, a borehole system 40. The system 40 comprises a borehole 42 in a subsurface formation 44. A string 46 is disposed within the borehole 42. An actuator 10 as disclosed herein is disposed within or as a part of the string 46.

Set forth below are some embodiments of the foregoing disclosure:

Embodiment 1: An actuator, including a housing having a flow conduit therethrough, a pressure balanced poppet disposed in the housing, initially preventing flow through the housing, and a heat evolving composition disposed to cause the poppet to move by fluid heating to cease preventing flow through the housing upon ignition of the heat evolving composition.

Embodiment 2: The actuator as in any prior embodiment, wherein the poppet includes a shaft that intersects the conduit.

Embodiment 3: The actuator as in any prior embodiment, wherein the shaft includes seals disposed on opposite sides of the intersected shaft.

Embodiment 4: The actuator as in any prior embodiment, wherein the poppet is movable relative to the housing by only overcoming friction of the seals.

Embodiment 5: The actuator as in any prior embodiment, wherein the poppet includes a head.

Embodiment 6: The actuator as in any prior embodiment, wherein the head includes a recess receptive to the heat evolving composition.

Embodiment 7: The actuator as in any prior embodiment, wherein the head is located in a recess of the housing.

Embodiment 8: The actuator as in any prior embodiment, wherein the heat evolving composition is disposed between the head and the housing.

Embodiment 9: The actuator as in any prior embodiment, wherein the fluid being heated is air.

Embodiment 10: The actuator as in any prior embodiment, wherein the heat evolution composition is gas evolutionless.

Embodiment 11: The actuator as in any prior embodiment, wherein the heating evolution composition is a thermite.

Embodiment 12: The actuator as in any prior embodiment, further including an igniter in physical contact with the heat evolution composition.

Embodiment 13: The actuator as in any prior embodiment, wherein the igniter is electrically responsive.

Embodiment 14: The actuator as in any prior embodiment, wherein the igniter is responsive to one of a remote signal or a locally generated signal based upon a sensed borehole parameter.

Embodiment 15: A method for actuating a tool, including igniting the heat evolution composition as in any prior embodiment, heating a fluid located between the poppet and the housing, driving the poppet to move with the heated fluid, and flowing fluid through the housing.

Embodiment 16: The method as in any prior embodiment, further comprising flowing fluid through the housing within 5 seconds of igniting the heat evolution composition.

Embodiment 17: A borehole tool, including the actuator as in any prior embodiment, a tool member disposed in the tool and movable by the fluid flowing through the housing, the movement of the tool member changing an operational condition of the tool.

Embodiment 18: A borehole system, including a borehole in a subsurface formation, a string in the borehole, the actuator as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator, comprising:

a housing having a flow conduit therethrough;

a pressure balanced poppet disposed in the housing, initially preventing flow through the housing; and a heat evolving composition disposed to drive the poppet to move by fluid heating to cease preventing flow through the housing upon ignition of the heat evolving composition.

2. The actuator as claimed in claim 1, wherein the poppet includes a shaft that intersects the conduit.

3. The actuator as claimed in claim 2, wherein the shaft includes seals disposed on opposite sides of the intersected shaft.

4. The actuator as claimed in claim 3, wherein the poppet is movable relative to the housing by only overcoming friction of the seals.

5. The actuator as claimed in claim 1, wherein the poppet includes a head.

6. The actuator as claimed in claim 5, wherein the head includes a recess receptive to the heat evolving composition.

7. The actuator as claimed in claim 5, wherein the head is located in a recess of the housing.

8. The actuator as claimed in claim 1, wherein the fluid being heated is air.

9. The actuator as claimed in claim 1, wherein the heat evolution composition is gas evolutionless.

10. The actuator as claimed in claim 1, wherein the heating evolution composition is a thermite.

11. The actuator as claimed in claim 1, further including an igniter in physical contact with the heat evolution composition.

12. The actuator as claimed in claim 11, wherein the igniter is electrically responsive.

13. The actuator as claimed in claim 11, wherein the igniter is responsive to one of a remote signal or a locally generated signal based upon a sensed borehole parameter.

14. An actuator, comprising:

a housing having a flow conduit therethrough;

a pressure balanced pop posed in the housing, initially preventing flow through the housing, the poppet a head, and a heat evolving composition disposed to cause the poppet to move by fluid heating to cease preventing flow through the housing upon ignition of the heat evolving composition, wherein the heat evolving composition is disposed between the head and the housing.

15. A method for actuating a tool, comprising:

igniting the heat evolution composition of the actuator as claimed in claim 1;

heating a fluid located between the poppet and the housing;

driving the poppet to move with the heated fluid; and flowing fluid through the housing.

16. The method as claimed in claim 15, further comprising flowing fluid through the housing within 5 seconds of igniting the heat evolution composition.

17. A borehole tool, comprising:

the actuator as claimed in claim 1; and a tool member disposed in the tool and movable by the fluid flowing through the housing, the movement of the tool member changing an operational condition of the tool.

18. A borehole system, comprising:

a borehole in a subsurface formation;

a string in the borehole; and the actuator as claimed in claim 1 disposed within or as a part of the string.

* * * * *